United States Patent [19]

Lancaster et al.

[11] 4,077,179

[45] Mar. 7, 1978

[54] AUTOMATIC WRAPPING APPARATUS

[76] Inventors: William G. Lancaster, 5101 Upper River Rd.; Patrick R. Lancaster, III, 9410 Tiverton Way, both of Louisville, Ky. 40222

[21] Appl. No.: 691,019

[22] Filed: May 28, 1976

Related U.S. Application Data

[60] Continuation-in-part of Ser. No. 478,523, Jun. 12, 1974, and a continuation-in-part of Ser. No. 493,050, Jul. 30, 1974, which is a division of Ser. No. 347,873, Apr. 4, 1973, Pat. No. 3,867,806.

[51] Int. Cl.[2] ..... B65B 11/04

[52] U.S. Cl. ..... 53/32; 53/184 R; 53/198 R; 53/211; 100/15

[58] Field of Search ..... 53/30 R, 30 S, 184 R, 53/184 S, 211, 198 R, 32; 100/15

[56] References Cited

U.S. PATENT DOCUMENTS

| | | | |
|---|---|---|---|
| 965,317 | 7/1910 | Nyberg | 53/211 |
| 1,329,311 | 1/1920 | Roberts | 53/30 R |
| 2,088,133 | 7/1937 | Evans | 100/28 |
| 2,811,916 | 11/1957 | Guilleminot et al. | 100/15 |
| 3,003,297 | 10/1961 | Broadhead | 53/198 R |
| 3,514,920 | 6/1970 | Hoffler | 53/198 R |
| 3,577,702 | 5/1971 | Bescript | 53/198 R |
| 3,788,199 | 1/1974 | Sato et al. | 93/80 |
| 3,863,425 | 2/1975 | Edwards | 53/211 |
| 3,910,005 | 10/1975 | Thimon et al. | 53/198 R |
| 3,994,118 | 11/1976 | Felix | 100/15 |

*Primary Examiner*—Othell M. Simpson
*Assistant Examiner*—John Sipos
*Attorney, Agent, or Firm*—Gipple & Hale

[57] ABSTRACT

An automatic wrapping machine comprising a film roll support adapted to hold a roll of film, a turntable adapted to hold a load of unitary members positioned adjacent to the film roll support, a drive apparatus to rotate the turntable and a brake adapted to place tension on the film web of the roll of elastic stretchable material carried in the roll support. A clamp assembly is mounted adjacent to the load to hold the film while the turntable with associated load rotates allowing film to wrap around the load and the clamp assembly. The clamping assembly includes a pneumatic device for activating the clamp after the completion of at least one revolution of turntable so that the clamping assembly is retracted from the film overwrap. A film cutting and clamping mechanism is located adjacent to the turntable to cut the film web after the load is wrapped and holds the free end of the film in a secured position. The holding clamp subsequently clamps around the film to hold the same in position for the wrapping of the next load after it is in position.

12 Claims, 8 Drawing Figures

AUTOMATIC WRAPPING APPARATUS

This is a continuation-in-part of U.S. patent application Ser. No. 478,523 filed June 12, 1974, and of U.S. patent application Ser. No. 493,050 filed July 30, 1974 which is a divisional application of Ser. No. 347,873, issued U.S. Pat. No. 3,867,806 filed Apr. 4, 1973.

BACKGROUND OF THE INVENTION

1. Field of Invention

The present invention relates to the automated unitization of multiple products into single loads that will maintain their unitary integrity throughout shipment. More specifically, this invention relates to a method and apparatus for dispensing and wrapping a stretchable film around a plurality of stacked units located on a rotatable turntable.

2. Description of the Prior Art

Automatic unitization of loads is currently being accomplished by various types of machines. Specific examples of such machines include strapping and string-tying equipment; automatic taping machines; palletizers that glue the products together by automatically dispensing hot melt between the units as they are being palletized; automatic shrink film placing units that work in conjunction with shrink tunnels; and automatic dual roll push through types stretch film wrappers.

The currently used automatic stretch film placing units stretch the entire web of film at the same time to force it around the load and heat seal the ends of the film together. This apparatus has the disadvantage of requiring enormous forces to stretch the film. In addition, the apparatus pulls the film across the corners of the load which may cause rupturing of the film or deformation of the load. Most importantly, the process requires a critically important seal to reliably secure the load during shipment. If the heat sealing jaws of the apparatus do not provide a perfectly uniform pressure and temperature along their entire length then the film seal will not be particularly strong. Thus the seal will be overheated in some areas which will melt the film thin, or crystalize it to a state of brittleness. Alternatively if the seal is underheated in some areas deterioration or unwrapping may occur under the tension of shipment.

In the present invention, the placing of a thin gauge film around the load in multiple layers requires considerably smaller forces to be used in order to obtain the film elongation as is required. As the load is rotated on a turntable, the application of the film to the load eliminates any sliding or abrading of the film as conventionally occurs. In the invention no seals are required when "tacky" film is utilized, as this type of film normally will have enough cling to bond to itself. In those instances where greater fastening is required, a simple tack seal bonds the trailing edge of the film to the layers already disposed about the load. As with the other types of machines the tack seal is completely automatic, which is a necessity in modern plants.

The main advantage of the present invention over the automatic strap, string and taping machines is that this invention spreads the unitizing forces over the product so that the forces are not concentrated at specific points which often tends to deform the product. The conventional solution of this problem is for padding to be placed beneath the straps. This placement is invariably performed by hand and thus defeats the automatic feature of the operation.

The prior art also discloses the glueing of bags or boxes in order to unitize multiple products into a single load. The glueing is frequently objectionable to the customers who must pull it apart and does not work particularly well when the product is column stacked.

The automatic improvement of the invention centers around the clamping and cutting technique. As the film-holding clamps are wrapped and removed prior to final revolution, the clamps can be positioned off the side of the conveyor thereby eliminating the possibility of the pallet load hitting the clamps. Additionally, the clamping and cutting process of the invention eliminates reliance on the pallet configuration or location to insure proper cutting action and clamping.

This invention is an improvement over the U.S. Pat. No. 3,867,806 in which a process for making a unitary package is disclosed. In the patent a load comprising a plurality of units is formed by wrapping a band formed of plural layers of a stretched material around the units. This patent requires the holding of the film's leading edge against the vertical surface of the package load by either manual or other non-disclosed fastener means. The present invention specifically discloses clamps located both on the rotatable conveyor and the top platen which serve to hold the leading edge of the film against the vertical side of the load to be wrapped. After the first layer of film is wrapped around the load and clamps, the clamps located on the platen and conveyor are placed in their retracted positions so that the load can be conveyed without interference from the clamps.

Upon completion of the fastening steps disclosed in the U.S. Pat. No. 3,867,806, the operator must sever the overwrapped package from the film dispenser by employing a drop-knife cutter means which is mounted adjacent the pallet support means. In the present invention, film clamp/cutter jaws are used which serve to hold the film in a vertical position while a toothed film cutting bar pierces the entire vertical length of the film at the same instant. In both inventions, the elongation of the film is due to the tension imparted thereon by a tension brake acting on the dispensing roll. Prior to separation the amount of elongation is uniform along the vertical length of the package. In the prior art mode of cutting the film by a sliding cutting knife, the tension is released and consequently the elongation decreased as the cutting blade passes through the film. Thus the amount of elongation at the top of the film through which the blade has passed will be less than the elongation present at the bottom of the film, where the blade has yet to pass. This lack of uniformity can lead to the load having a non-uniform stretched film. Consequently a less functional wrap is produced which in addition is less aesthetically appealing. Such appearance is critical in clear plastic wrapped packages. This is so in spite of the fact that the cutting operation is performed subsequent to the sealing operation. Conversely, the present invention cuts the entire length of the film at one time, thereby keeping the amount of tension and percent of elongation constant and uniform alongthe length of the film. The uniformity of tension provides a more functional and aesthetically pleasing package. The effect of a onetime total length cut is further enhanced by the fact that the present invention utilizes a tacky film. This particular type of film does not require any additional sealing means other than the wipe operation of a brush which secures the trailing edge to the vertical side of the package.

U.S. Pat. No. 3,514,920 discloses an apparatus for overwrapping a package by means of a heat shrink film shrunk around a load to provide a unitary package. In that patent the heat-shrinkable plastic film used as an overwrap for the package has a substantially rectangular configuration and has a leading edge portion fastened against the cartons. It will be noted that this apparatus specifically requires the operator to attach the leading edge of the plastic film to the cartons. The present invention, as previously mentioned eliminates this manual operation. In addition to holding the leading edge of the film against the load, the present invention comtemplates the performance of a cutting operation. After the next load is in position, the wrapping clamps grab and hold the new leading edge of the film in order to facilitate the packaging of the pallet and associated load.

The present invention eliminates the use and excessive cost of heat tunnels since the film used is stretchable and consequently no heat is required to secure the package.

U.S. Pat. No. 3,793,798 discloses a shrink palletized process and apparatus. That particular package and process also specifically contemplates the manual withdrawing of the leading edge of the film and holding that leading edge against the package. The present invention, however, performs this task automatically.

An additional advantage of the present invention is the use of the upper platen clamp in conjunction with lower conveyor located clamp. The utilization of the two clamps allows the film to be held firmly against the load at two points. This allows the package to be wrapped uniformly with equal film tension and elongation along the entire length of the vertical sides of the load.

In previously developed stretch-film wrapping machines, an edge of the film is either tacked or sealed to the previously wrapped film layers prior to the time of film cutting or separation. This is required because it is necessary to maintain the backward tension and consequently the elongation of the film prior to separation in order for a tight seal to be produced. After the seal is formed, the film is cut. This leaves a portion of the film i.e. between the seal and the trailing edge as wasted film. The present invention avoids this waste of film by cutting the film and subsequently wiping the film against the vertical side of the load thereby utilizing the entire film length in a functional capacity.

Other wrapping patents of general interest are U.S. Pat. Nos. 3,795,086 and 3,589,102. Patents which disclose the spiral wrapping of articles and are of interest are U.S. Pat. Nos. 2,575,467, 3,003,297, 3,788,199 and 3,863,425.

SUMMARY OF THE INVENTION

The invention comprises a novel apparatus and process for automatically making unitary wrapped packages.

A series of loads, each containing a plurality of cartons are fed into a wrapper apparatus and automatically covered by a stretched film to form a unitary package. The present invention contemplates the use of two sets of film holding clamps which rotate with the turntable and platen and are wrapped inside the film in at least the initial turntable revolution. Additionally, a set of film web clamping and cutting jaws are provided which sever the film roll from the load being wrapped and hold the supply film for the start of the succeeding load. The trailing edge of the wrapped film is brushed smooth against the wrapped load and is held by the "tackiness" present in the film or alternatively heat sealed in a later process.

In the automated stretchable film apparatus a roll of clear stretchable film is held on a vertically arranged dispensing means. Film holding clamps are located upon an upper platen and along one edge of a rotatable load supporting conveyor. At rest, the platen and turntable film clamps are open, the platen is in its "up" position and the cutter clamp jaws engage the film. A load comprising a pallet and package units thereon is conveyed onto the turntable and stopped in the proper position when sensed by a photo-electric cell. Subsequently, the top platen is lowered to stabilize the load and the platen and turntable clamps close to clamp the film. These clamps are designed to hold the film securely against the starting forces on the film and to be able to retract without tearing the film. In normal operation, the clamps will be retracted after approximately $1\frac{1}{4}$ turns of the turntable in order to allow the highest level of resultant tension on the load. The platen and turntable film clamps are retracted after $1\frac{1}{4}$ turns to allow subsequent layers to be wrapped directly against the load. The retraction of the clamps, prior to the final wrap layers, allows the film holding clamps to be placed on the side of the conveyor, free from damage by passing pallets. Additionally, the clamps are located at the mid-point of a side of the load in order to allow for maximum "forgiveness" in pallet alignment and register with respect to the leading edge of the film.

The cutter clamp jaws retract to their open position and the turntable rotates the load, which causes the film to be wrapped around the load. A film brake imparts a desired restriction on the film roll to elongate the film and stretch it around the load. When the desired number of film layers are wrapped on the load, the turntable comes to a stop in its rest position. Additional cutting reliability may be achieved by automatically reducing or increasing tension to a given level in the last quarter turn to compensate for the type of film being used.

A "U" shaped film clamping jaw is used to pull the film web into its cutting position for engagement with the blade holding film cutter/clamping jaw. As the two film cutter/clamping jaws close, a toothed vertical blade which extends beyond the edge of the jaws punctures the film as one of the horns of the "U" clamps the film against a rubber pad carried on the cutter/clamping jaw. Consequently, this clamping action holds the leading edge of the film in position for the wrapping of the succeeding load. Thus it can be seen that this system is extremely versatile and reliable because it does not require a precise alignment of blades; and is relatively independent of load size, configuration, rigidity or placement. As previously mentioned this invention contemplates the use of no electrical heating parts. If the cutting bar merely perforates the film and does not completely cut the film web, the movement of the exiting load will tear the film apart between the perforations. The film will then be wiped down flat against the finished package by a vertically held brush. It will be appreciated that in most cases, the film will have sufficient tackiness so as not to require any further bonding. However, if necessary, a heat sealing operation can be added to the apparatus on the exit conveyor.

In an alternate embodiment, the apparatus is provided with a movable roll carriage in order to expand the machine's capabilities to include spiral wrapping of very tall loads or random loads of varying height. If such is the case, the film web is usually much narrower and therefore, requires smaller forces to stretch it. These smaller forces may eliminate the need for the top platen for low production where the turntable rotation speed does not require a top platen for stability. The spiral wrap apparatus is nearly identical to the full web. The film starting requires only a bottom clamp, if the spiral is to start and stop at the bottom. Conversely, it requires only a top clamp if the film is started and stopped at the top. The identical clamping/cutting mechanism described is also used for the spiral configuration and the clamping/cutting bar need not be any longer than the web width of the film in order to perform its function properly.

While the start and finish of the spiral operation functions the same as the full web, the wrapping process lends itself to great versatility. If the machine is to start and stop at the bottom of the machine, after the initial revolution of the turntable, the film roll is raised to spiral the film onto the load. While at the top or bottom, any number of predetermined wrap layers can be dispensed to hold and secure the product. The rate at which the film is raised and lowered determines the amount of film that will be dispensed.

The above mentioned purposes are more readily apparent when read in conjunction with the following detailed description of the preferred embodiment of the present invention.

DETAILED DESCRIPTION OF THE DRAWINGS

Figure 1:
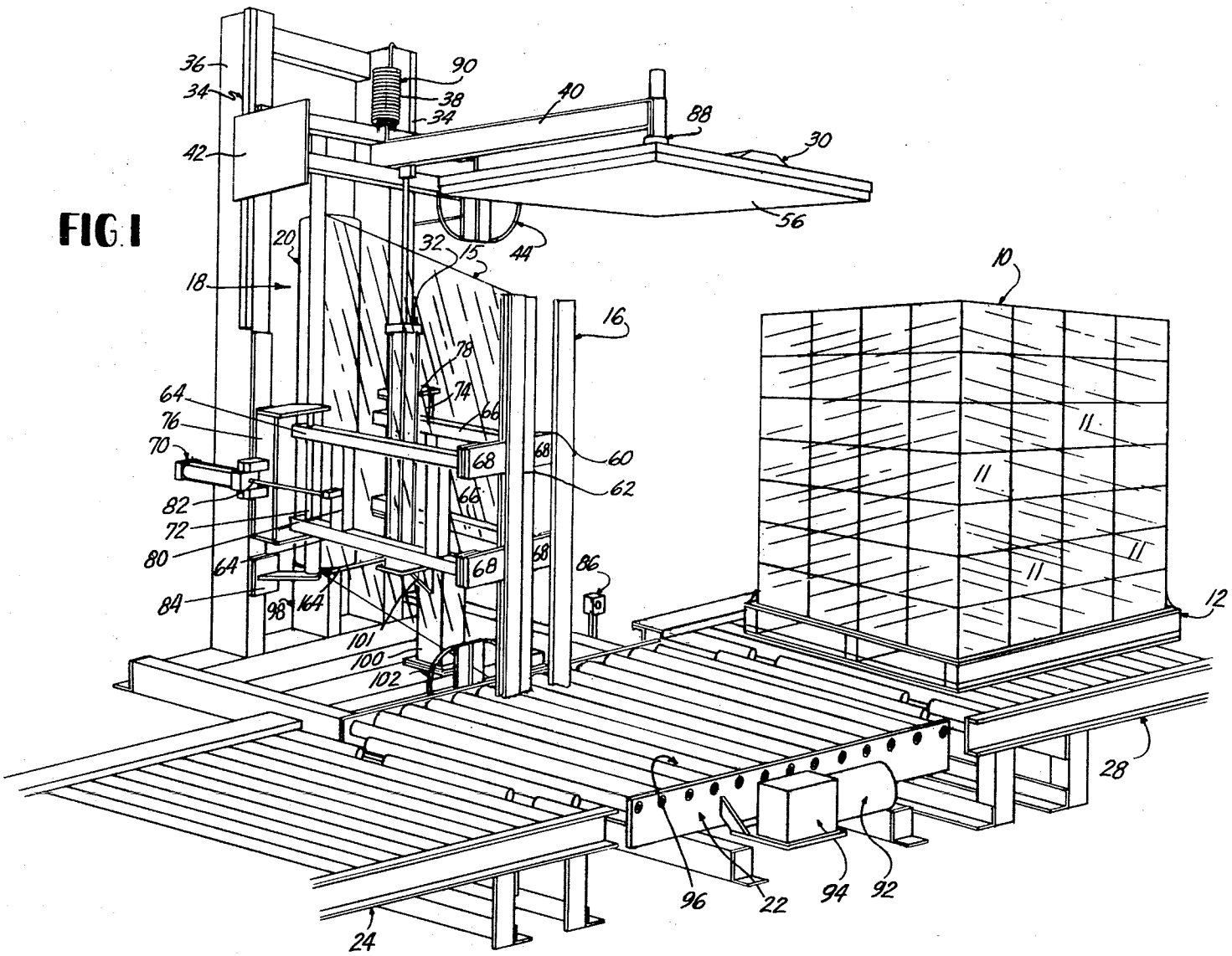
FIG. 1 is a perspective view of the automatic wrapping apparatus, outgoing pallet with wrapped load located thereon, and associated rotatable conveyor.

Referring to the drawings and more particularly to FIG. 1, there, is illustrated a wrapped package 10 produced through use of the automatic wrapping apparatus of the present invention. The package 10 comprises a palletized load of boxes 11 located upon a conventional forklift pallet 12. The vertically arranged portion of the load is overwrapped by a band 14 formed of plural layers of a stretchable sheet of material as for example P.V.C. The layers of the stretchable material are secured together by the tackiness of the material to form a cumulatively homogenous band of film. The trailing edge of the film is likewise secured against the layer beneath it by brush 16.

FIG. 1 shows the film dispenser apparatus 18 and the roll of film 20 adjacent to rotatable turntable 22 which supports the load during the wrapping operation. A first conveyor means 24 carries the palletized load to the rotatable turntable 22. A second conveyor means 28 carries the wrapped palletized load off the rotatable turntable 22. A top platen 30 serves to stabilize the load during the wrapping cycle. The top platen 30 is raised or lowered by actuating air cylinder 32 which allows the platen to move up or down by sliding along vertical slide bars 34 which are secured to the apparatus' vertical supports 36, 38. The air cylinder 32 is supported by bracket 101 which is in turn supported by vertical support post 100. The top platen 30 is held in relative suspended position by a horizontal platen support arm 40 which is in turn secured to the platen carriage 42. The platen carriage 42 slides along vertical slide bars 34 on roller bearings (not shown).

Figure 6:
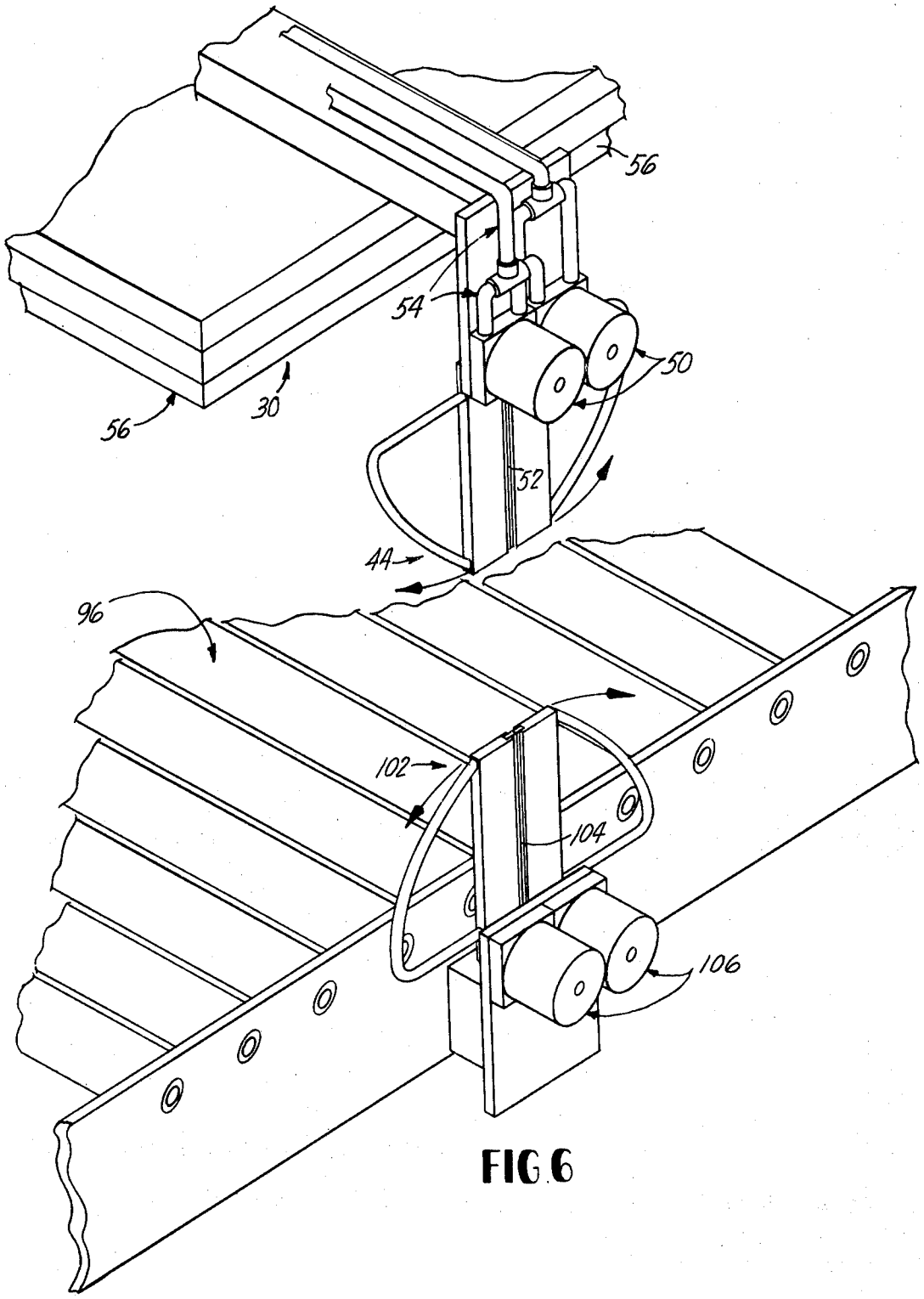
FIG. 6 is a perspective view of the turntable film clamps and top platen film clamps in their closed position.

The lower surface of the platen 30 is composed of a resilient material 56 so that when the platen is lowered the load is not crushed by the platen's weight. A set of platen film clamps 44 are pivotally secured to the rear vertical wall of the platen 30 as best seen in FIG. 6. The rotary air cylinders 50 activate the platen film holding clamps 44 so that they spread apart. Air lines 54 serve to activate the cylinders and are in communication with a source of pressure which is not shown.

An air slip ring 88 allows the top platen 30 and its attached clamps 44 to rotate along with the load and still maintain the clamps in a closed or open position as desired. The coiled air line 90 runs along the platen support arm 40 to the air slip ring 88 which is connected through lines 54 to the air cylinders 50 to film clamps 44. The use of the air slip ring allows the platen and clamps to be rotated while still maintaining the clamps in contact with the air supply. Rubber edges 52 secured to the clamps hold the film in place between the film clamps when closed.

A set of film clamping/cutting jaws 60 and 62 for clamping and cutting the film at the end of the wrap are held in vertical position by horizontal swing arms 66 and 64 respectively. The jaws 60 and 62 are secured to the horizontal swinging arms 66 and 64 by frontal holding bars 68. Air cylinders 70 are secured to the apparatus vertical supports 36 and 38 and serve to rotate the horizontal swinging arms 64 and 66 about vertical shaft 72 and 74, respectively by acting on cross support 80. The vertical shafts 72 and 74 are secured to brackets 76 which are in turn secured to apparatus vertical supports 36 and 38. The air cylinders 70 rotate the horizontal swinging arms 64 and 66 by acting upon a cross support 80 by means of sliding piston rod 82. Thus the horizontal arms rotate around the vertical shafts.

Electric photocell 86 senses when the front of the load and pallet are in position and serves to stop the conveyor drive motor 92 to place the load and pallet in proper wrapping position.

An electric drive motor 92 and connected gear reducer 94 drives the turntable rollers 96, which allows the palletized load to be stopped in the proper position, and later to be moved when wrapped.

Turntable film clamps 102 are mounted on the side vertical edge of the turntable, as best seen in FIG. 6. The pair of clamps hinge at their pivot point and are activated by rotary air cylinders 106. Rubber edges 104 serve to hold the film when the turntable clamps 102 are in their operative or closed position. It should be noted that when turntable clamps 102 are opened to release the film the two jaw segments each pivot open 90° so that the clamp jaws are beneath the level of the turntable.

Similarly when the platen clamps 44 are in open position, the two jaw segments each pivot open 90° so that the clamp jaws are above the level of the platen. The clamps holding the film are retracted after the film has been secured to the load by wrapping more than one revolution, so that the clamps do not interfere with the remainder of the wrapping process.

Figure 2:
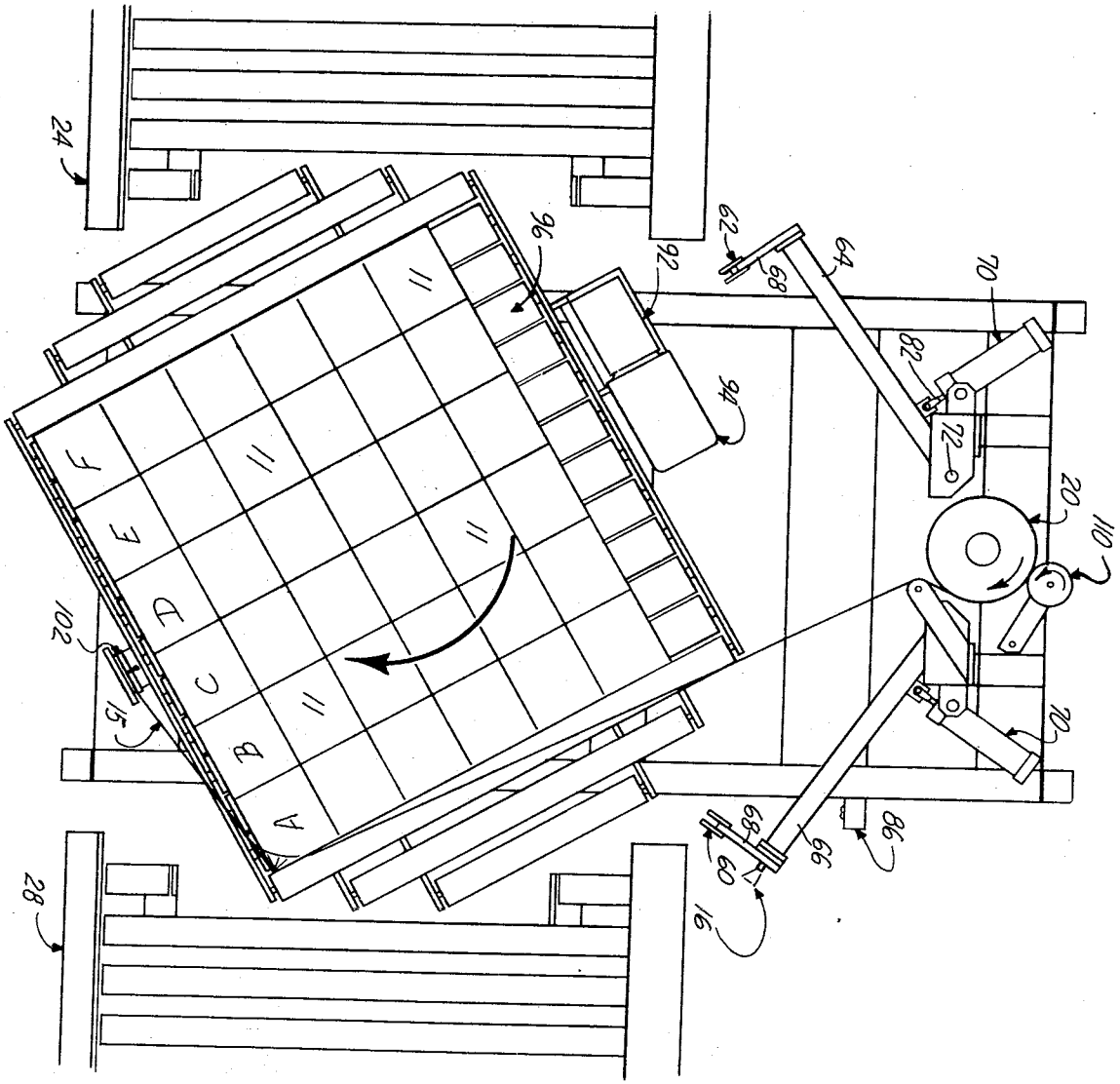
FIG. 2 is a top plan view, with top platen removed, of the wrapping apparatus with the pallet and load located on the turntable which has been rotated through 130° of the first revolution of the wrap cycle.

FIG. 2 is a top view of the machine after 130° rotation of the first revolution of the wrap cycle. As is shown, the turntable clamp 102 holds the leading edge of the film 15 between rubber edges 104 as turntable 22 rotates to pull film off the film roll 20.

The film is placed under tension so that it stretches as it is being wrapped around the load. Rubber friction rollers 110 mounted on a rotatable shaft 112 engage the surface of the film roll to restrict the film as it is being unwound. A brake 160 engages the rotatable shaft to limit the rotation of the shaft as the rollers are driven by the rotating surface of the film roll thus allowing the desired degree of tension to be applied to the film.

Figure 3:
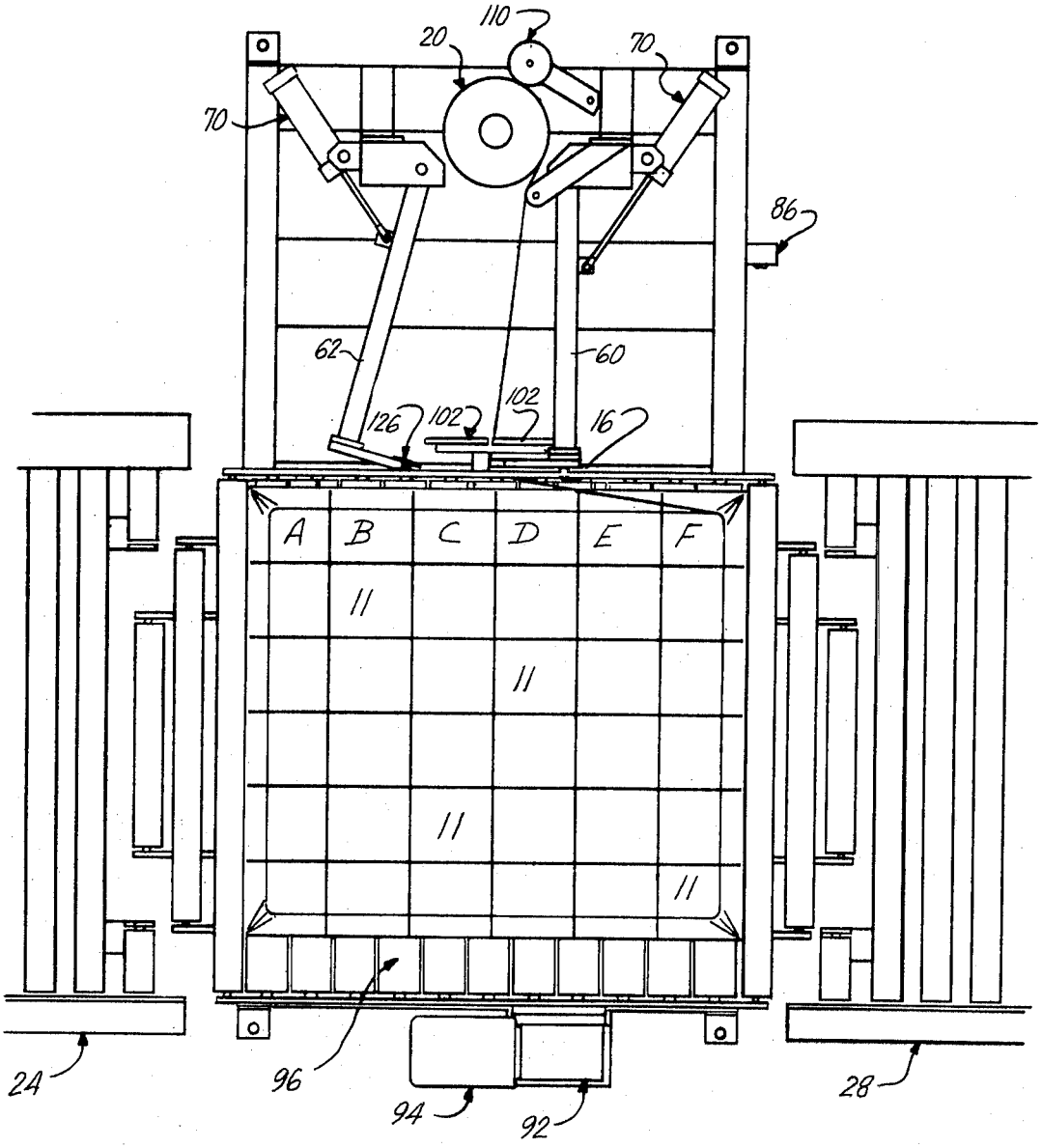
FIG. 3 is a top plan view, with top platen removed, of the wrapping apparatus with pallet and load located on the rotatable turntable, at the completion of the wrap cycle.

FIG. 3 is a top view of the machine at the completion of the wrap cycle. The left film clamp/cutter jaw 62 is shown in mid-stroke. Turntable film clamps 102 are open at this point in the cycle.

Figure 4:
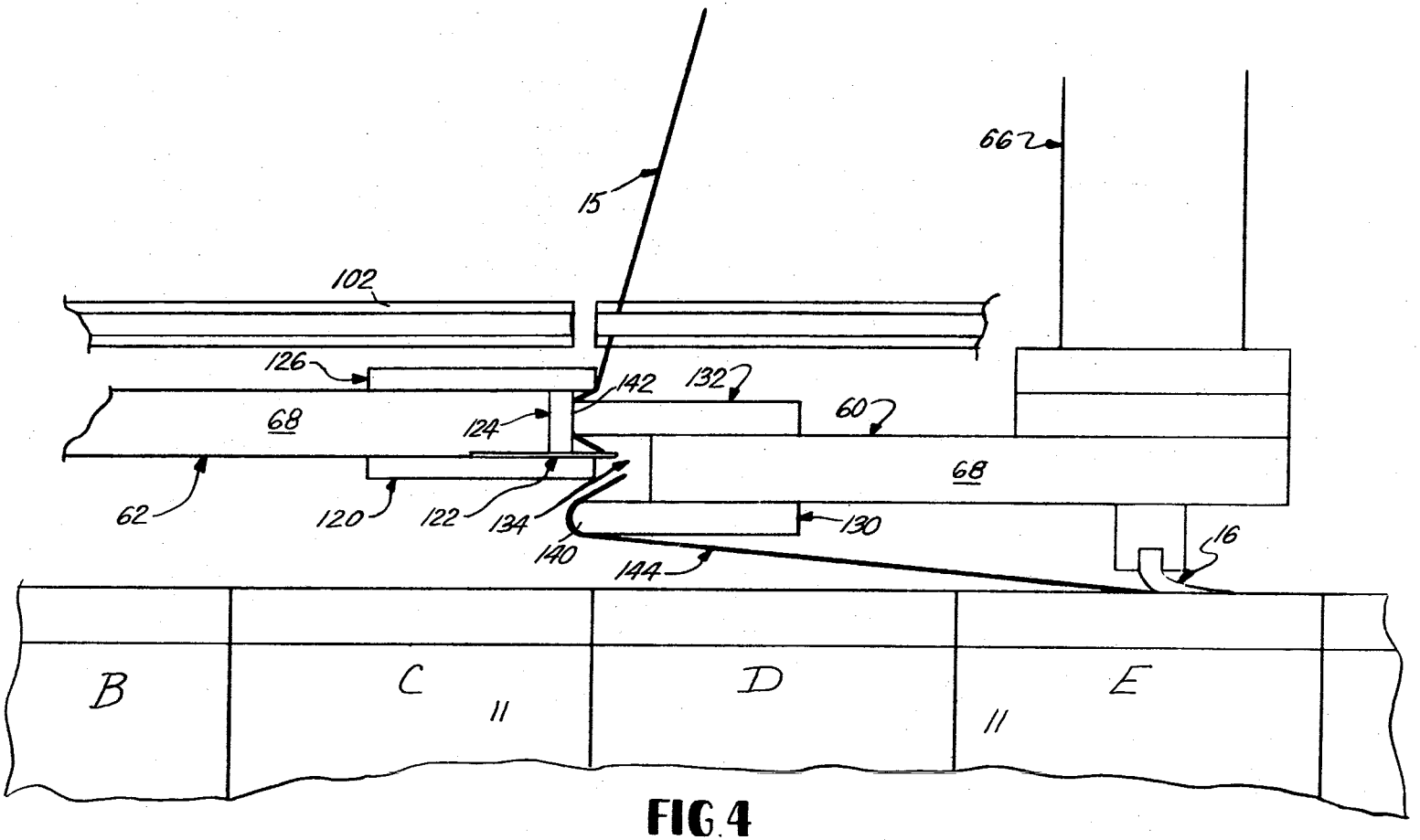
FIG. 4 is a top plan view of the film clamp/cutter jaws showing the film location just as the clamps are fully closed.

FIG. 4 is a detailed top view of the film clamp/cutter jaws 60 and 62 showing the film location just as the clamps are fully closed. The left film clamp/cutter jaw 62 comprises a support arm 68, a blade support bar 120 secured to the support arm, a toothed film cutting blade 122, a resilient film clamping pad 124 and a pad support bar 126. The cutting edge of the toothed film cutting blade extends beyond the forward edge of the blade support bar 120. The right film clamp/cutter jaw 60 is made up of a film web pusher bar 130, a clamp bar 132 which is positioned across from bar 130 so as to create an open space 134 between them and a "U" shaped configuration. The film brush 16 is also secured to the right film clamp/cutter jaw 60 on arm 68 at the frontmost portion of support bar 66. The operative edge 140 of the film web pusher bar 130 is arcuately shaped so as not to tear the film. The operative edge 142 of the clamp bar 132 is flat so as to engage and hold securely the film 15 against the resilient clamping pad 124.

In operation, it can be seen that the entire width of the film web is easily and reliably clamped and cut in one single operation. The cutting and clamping operation allow the film tension to be altered prior to the film being actually cut. With the film 15 drawn over the right film clamp/cutter jaw 60 in the position shown in FIG. 3, the left film clamp/cutter jaw 62 engages it to clamp the film web between clamp jaw 132 and the resilient pad 124. As the resilient pad 124 is compressed the cutting edge of the toothed film cutting bar 122 punctures and cuts the film as it forces it apart in the space 134. Motion of the wrapped load on the turntable conveyor also can apply tension to the film so that it will be severed by the cutting bar 122. The film is held between the film clamp bar 132 and the resilient pad 124 which now becomes the leading edge of the film for the next succeeding load and pallet. Severed film portion 144 becomes the trailing edge of the load being wrapped. As previously mentioned, the turntable film clamps 102 and top platen clamps 44 are in the open position at this time in the cycle. The position of package units C, D and E is the same as in FIG. 3.

Figure 5:
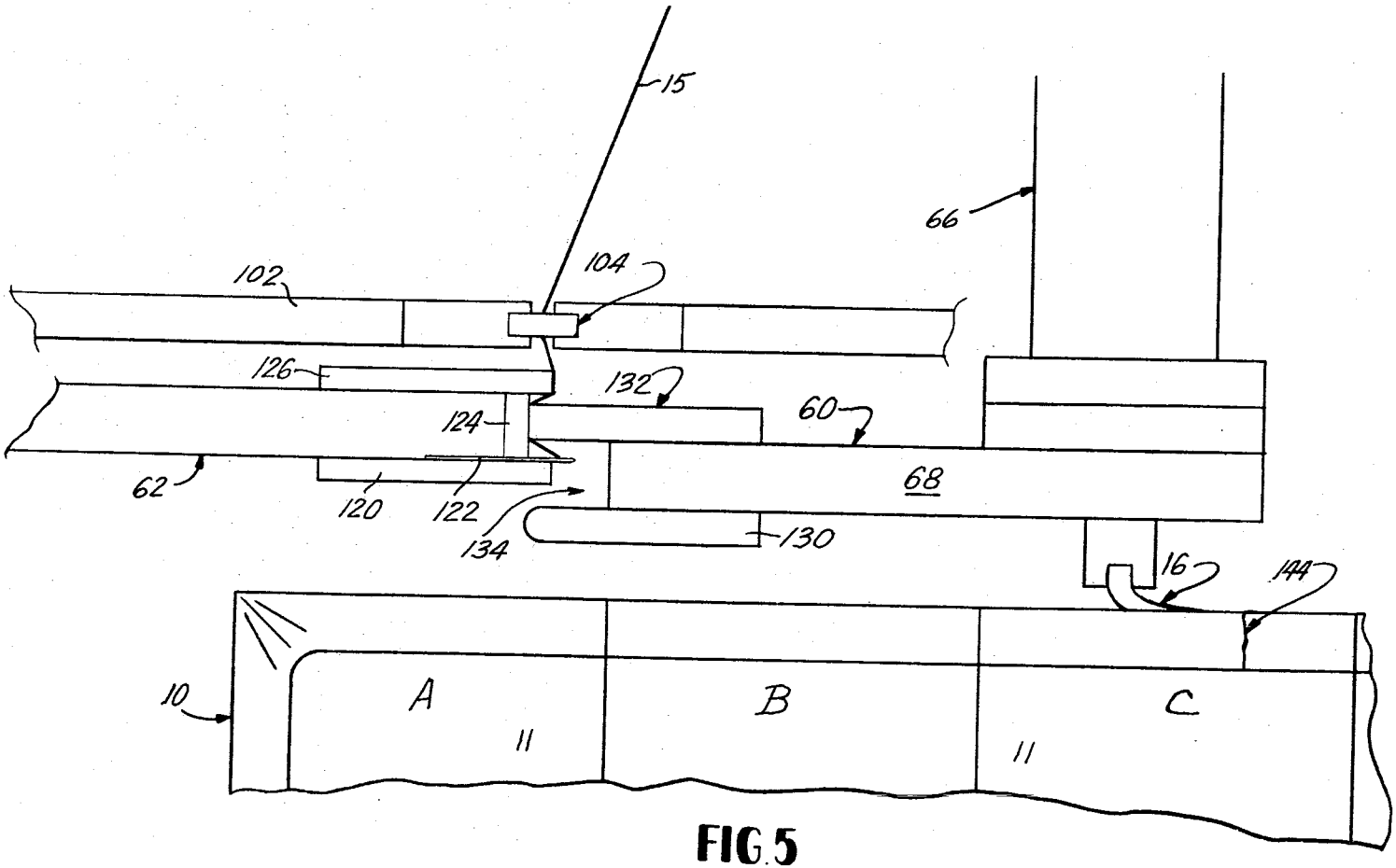
FIG. 5 is a detailed top plan view of the film clamp/cutter jaws showing the film location during the immediately succeeding step of the wrapping cycle as shown in FIG. 4.

FIG. 5 is the same view as FIG. 4 during the following phase of the wrapping cycle, with the load 10 moving off of the rotatable turntable 22. Package unit D has moved to the right of its position in FIG. 4. Film web 15 is still held firmly between film clamp/cutter jaws 60 and 62 and the turntable film clamp 102 is in clamped position with its rubber edge 104 holding the film web. The trailing edge 144 of the film web is then wiped down by brush 16 so that it adheres to the wrapped package.

Figure 7:
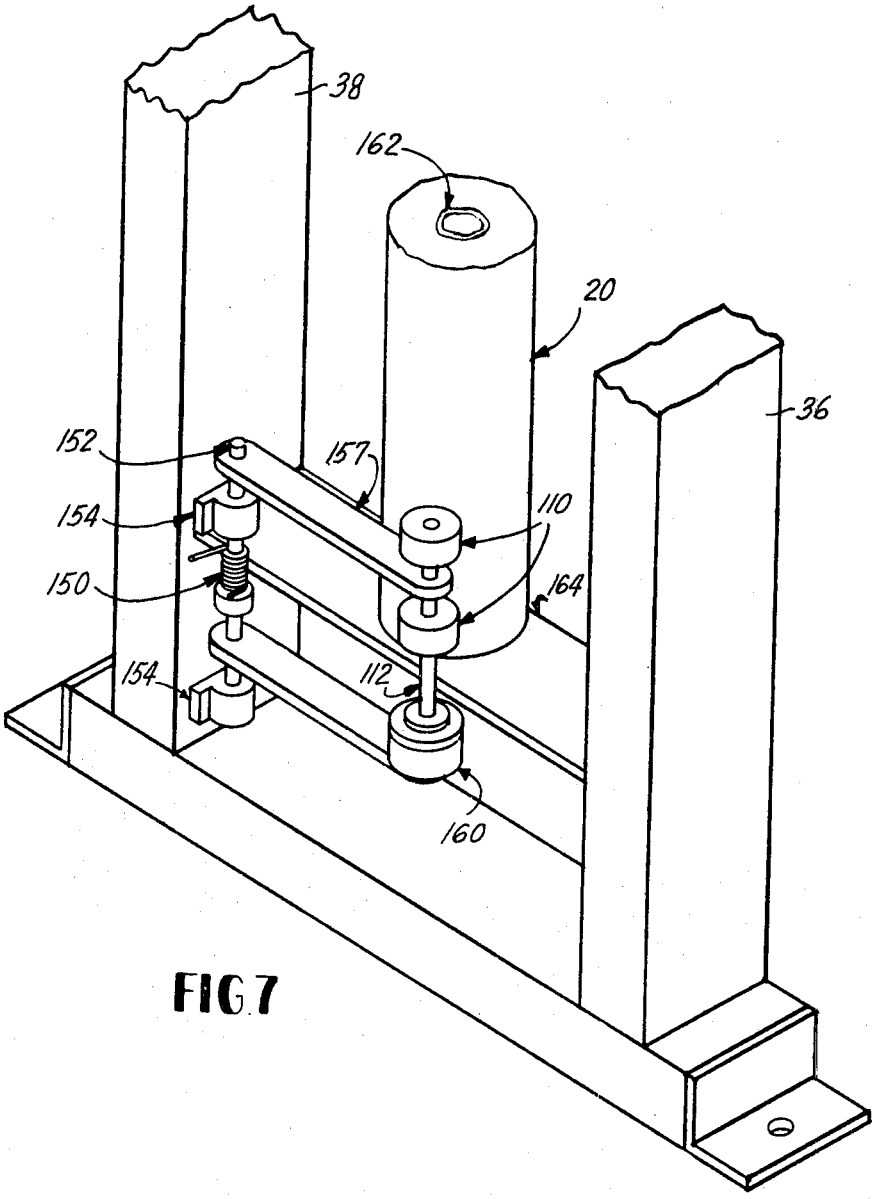
FIG. 7 is a perspective view of the film brake mechanism.

The film brake mechanism, as best seen in FIG. 7, comprises rubber wheels 110 which are held against the film roll 20 by a tension spring 150 acting through shaft 152. The shaft 152 is supported by and rotates in pillow blocks 154 which are secured to vertical support 38. Support arms 156 and 157 are in parallel relation to each other and arm 157 rotatably holds shaft 112. The brake 160 is mounted on the lower support arm 156 and supports shaft 112. The upper support arm 157 lies between the two rubber wheels 110. Thus the rubber wheels 110 are always held against the rotating film roll 20 by spring 150 and brake 160 serves to transfer braking torque through shaft 112 to rubber wheels 110 in order to stretch the film web 15 as it is being drawn off by the turntable rotation. The film roll 20 rotates on rigid shaft 162 which is supported by horizontal support plate 164. The brake 160 can be selectively regulated to place varying braking forces on shaft 112.

Thus varying types of film can be used in the apparatus allowing variance of the film tension at the time of severing by setting a control to change the braking force to the desired tension needed when the film is severed. This varying tension facilitates the cutting and clamping of the trailing edge of the film.

Figure 8:
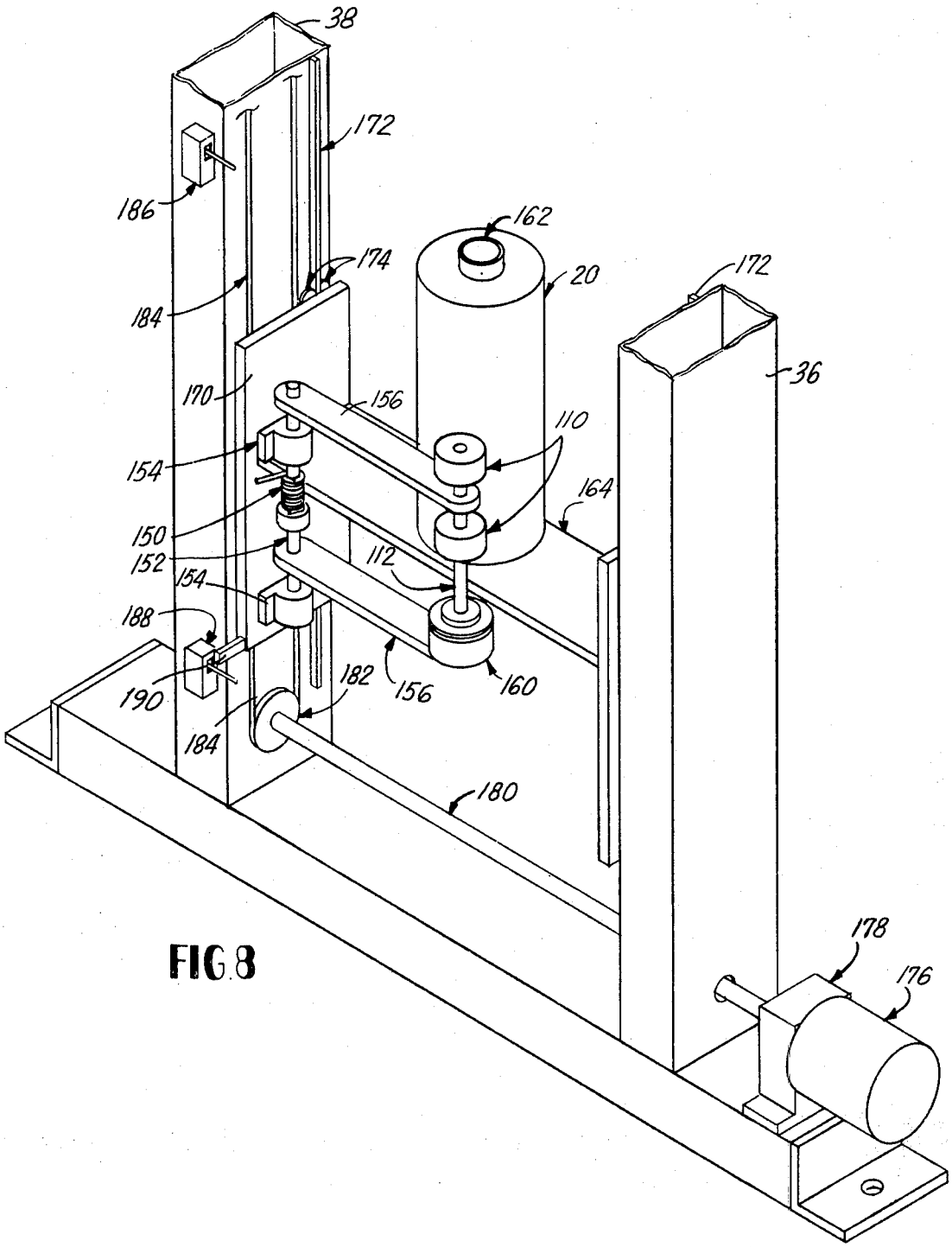
FIG. 8 is a perspective view of the spiral wrapping embodiment.

An alternate embodiment to the invention is shown in FIG. 8 wherein a spiral wrapping embodiment is shown comprising a cradle 170 which slides along vertical rails 172 on wheels 174. The vertical rails 172 are secured to the interior sides of the vertical supports 36 and 38. The cradle 170 is driven by motor 176 through gear reduction box 178. The motor causes shaft 180 to rotate, consequently rotating chain sprockets 182 and chain 184. The upward travel of the cradle 170 is limited by upper limit switch 186 while the downward travel of the cradle 170 is limited by lower limit switch 188. The limit switch cut-off tab 190 is attached to the cradle 170.

In operation in the spiral configuration the palletized load is placed on the turntable and any desired number of rotations is performed with the cradle in the lower or upper position so that a plurality of layers of film is dispensed onto the load to fasten the film to the load. The cradle 170 then travels along the rails 172 as the turntable continues to rotate. The film is continuously pulled off the film roll so that the film is now being placed in overlapping bands about the load as previously discussed on page 10.

An alternate sequence is available where, as the cradle continues to travel, the limit switch located on the opposite end from which the wrapping commenced is reached. At this point any desired number of end wrappings may be performed before final cutting takes place. The clamping/cutting jaws operate in the same manner as they operate in the preferred embodiment. Since the height of the clamping/cutting jaws 60 and 62 is greater than the maximum distance of travel of the spiral cradle, then the jaws will perform their cutting function regardless of the final position of the film roll in the cradle.

While the preferred embodiment of the invention has been disclosed, it is understood that the invention is not limited to such an embodiment since it may be otherwise embodied in the scope of the appended claims.

What is claimed is:

1. A process of making a unitary package from a load comprising a plurality of units comprising the steps of:

a. placing successive loads on a conveying device;

b. transporting one of said loads to a wrapping apparatus;

c. holding a leading edge of a stretchable elastic material in a clamp assembly positioned between the forward and trailing corners of said load in a fixed position adjacent to said load;

d. placing said stretchable material under tension to cause said material to be stretched while rotating said load and said clamp assembly to form an overwrap around said first load and clamp assembly to form a film wrap of at least one layer of stretched film material;

e. releasing the leading edge of stretchable elastic material from said clamp assembly and retracting said clamp assembly from said film wrap away from said load after the first revolution of the load so that the clamp assembly is pulled out of the film wrap and the stretched film assumes the former position of the clamp assembly to cover the area vacated by the clamps assembly;

f. severing said stretched film material from said wrapping apparatus to form a leading edge and a following edge of said wrapped load; and simultaneously g. clamping the leading edge with clamp assembly in a position to begin wrapping of the following load.

2. A process of making a unitary package as claimed in claim 1 wherein said clamp assembly is retracted by rotating it away from said load.

3. An automatic wrapping machine comprising a film support means adapted to dispense a roll of film, a turntable adapted to hold a load positioned adjacent to said film support means, means to rotate said turntable, brake means adapted to place tension on a film web of stretchable material, a clamp means mounted on said turntable adjacent to said load to hold said film while said turntable with associated load rotates allowing film to wrap around said load and said clamp means, said clamp means including release means for releasing said clamp from said film web wrap after completion of at least one revolution of said turntable, a second clamp means mounted above said film web to hold the upper edge of said film, means to move said first and second clamp means, said first and second clamp means being moveably mounted so that upon retraction the turntable clamp means recedes from the film overwrap below the bottom level of the edge of the film web overwrap and the upper clamp means raises from the film web overwrap above the top level of the edge of the film web overwrap, a film cutting and clamping means positioned adjacent to said turntable, said film cutting and clamping means having means to cut the film web after the load is wrapped, clamp the free end of the film in a secured position and position the film to be held by the turntable clamp means for the wrapping of the next load.

4. An automatic wrapping machine comprising a film support means adapted to dispense a roll of stretchable film, a turntable adapted to hold a load positioned adjacent to said film support means, brake means adapted to place tension on a film web of stretchable material to substantially stretch said film web, a clamp means mounted to said turntable adjacent to said load to hold said film while said turntable with associated load rotates allowing film to wrap around said load, said clamp means including release means for releasing said film after completion of at least one revolution of said turntable and withdrawing said clamp means from said film wrap, a film cutting and clamping means positioned adjacent to said turntable, said film cutting and clamping means being adapted to cut the film web after the load is wrapped, clamp the free end of the film web in a secured position and position the film web for engagement by the turntable clamp means to hold it for the wrapping of the next load, said film cutting and clamping means comprising a pair of cooperating aligned jaws pivotally mounted for horizontal travel, said jaws allowing said load to freely rotate when they are in a first position and engaging the film web in a second position to cut and clamp it near one side of said load after the said load is wrapped with film, one of said jaws comprising a film cutting blade mounted next to a film clamping pad member, with the other jaw having a substantially "U" shaped cross section made up of two operative edges so that when the jaws close, one operative edge of said substantially "U" shaped jaw draws the film web into the cutting position and the other operative edge of the "U" shaped jaw engages said pad member of the one jaw to clamp said film, the two operative edges of said other jaw providing a captive space between which the film cutting blade can sever the film web.

5. Apparatus as claimed in claim 4 wherein said film support means is moveably mounted on a vertical track means and includes drive means adapted to move said film support means reciprocally to provide overlapping layers of stretched film on said load rotated by said turntable.

6. Apparatus as claimed in claim 4 wherein said film cutting blade is provided with a plurality of teeth.

7. An automatic wrapping machine comprising a film support means adapted to dispense a roll of film, a turntable adapted to hold a load positioned adjacent to said film support means, means to rotate said turntable, brake means adapted to place tension on a film web of stretchable material, a clamp means mounted on said turntable adjacent to said load to hold said film while said turntable with associated load rotates allowing film to wrap around said load and said clamp means, said clamp means including release means for releasing said clamp from said film wrap after completion of at least one revolution of said turntable, a platen movably mounted to said film roll support means, said platen being formed with a resilient lower surface adapted to engage the top of the load and hold said load in position on said turntable, a rotatable clamp means mounted on said platen, said rotatable clamp means being adapted to hold said film while said turntable with associated load rotates allowing film to wrap around said load and said rotatable clamp means, said rotatable clamp means including means to retract it from said film wrap after completion of at least one revolution of said turntable, a film cutting and clamping means positioned adjacent to said turntable, said film cutting and clamping means having means to cut the film web after the load is wrapped, clamp the free end of the film in a secured position and position the film to be held by the turntable clamp and rotatable clamp for the wrapping of the next load.

8. Apparatus as claimed in claim 7 wherein said rotatable clamp means comprises a pair of substantially hemispherically shaped opposing members.

9. Apparatus as claimed in claim 8 wherein said clamp members hinge at a pivot point and are activated by cylinder means, each of said clamp members having resilient edges serving to hold the film when the clamp members are in their closed position.

10. Apparatus as claimed in claim 7 including brush means positioned adjacent to said load, said brush means engaging the film web wrapped around said load to secure it to the underlying film layer.

11. Apparatus as claimed in claim 7 wherein said film is polyvinylchloride.

12. The process of claim 1 including the step of securing the severed following edge of said wrapped load film to an underlying layer of film.

* * * * *